United States Patent [19]

Saint-Remy Pellissier

[11] 3,999,424

[45] Dec. 28, 1976

[54] STRAIN-GAUGE PRESSURE DETECTOR FOR PENETROMETER

[75] Inventor: Charles Marc Marie Saint-Remy Pellissier, Avignon, France

[73] Assignee: Fondasol-Technique, Societe Anonyme, Avignon, France

[22] Filed: Aug. 11, 1975

[21] Appl. No.: 603,880

[30] Foreign Application Priority Data

Aug. 12, 1974 France ..... 74.28637

[52] U.S. Cl. ..... 73/81; 73/84

[51] Int. Cl.[2] ..... G01N 3/48

[58] Field of Search ..... 73/81, 84, 82

[56] References Cited

FOREIGN PATENTS OR APPLICATIONS

| | | | |
|---|---|---|---|
| 1,338,891 | 8/1963 | France | 73/81 |
| 218,504 | 8/1968 | U.S.S.R. | 73/84 |
| 167,657 | 2/1965 | U.S.S.R. | 73/84 |

*Primary Examiner*—James J. Gill
*Assistant Examiner*—Anthony V. Ciarlante
*Attorney, Agent, or Firm*—Karl F. Ross; Herbert Dubno

[57] ABSTRACT

The point, lower-end region, and shaft of a penetrometer tube set are respectively connected to lower, intermediate, and upper members of a sensor head. A cap member which slidably receives the upper member is struck by the penetrometer anvil to drive the tube set into the ground. The lower and intermediate members are respectively slidable in the intermediate and upper members, and upper, intermediate, and lower strain gauges are provided between the members to produce outputs corresponding to the forces exerted by them on each other. A group of pawls can lock the upper member onto the shaft of the tube set and the intermediate member is limitedly axially displaceable in the cap member so that the intermediate strain gauge is compressed on pulling-out of the tube set.

10 Claims, 4 Drawing Figures

STRAIN-GAUGE PRESSURE DETECTOR FOR PENETROMETER

CROSS-REFERENCE TO RELATED APPLICATIONS

This application is related to my copending patent applications Ser. Nos. 543,951, 543,953, (U.S. Pat. No. 3,958,646 of May 25 1976), and Ser. No. 601,447 filed 24 Jan. 1975, 24 Jan. 1975, and 4 Aug. 1975, respectively.

FIELD OF THE INVENTION

The present invention relates to a device for measuring the resistance to penetration and extraction for a penetrometer of the type comprising several parts fitted one in the other and between which are interposed electronic force pick-ups, in particular pick-ups of the strain-gauge type.

BACKGROUND OF THE INVENTION

A penetrometer is an apparatus for exploring the ground by driving into the ground a probe located at the lower end of a set of tubes ensuring the transmission of the forces to a measing device placed at the top of this set of tubes.

The conventional measurements which may be carried out by means of a penetrometer, for so-called static operation are measurement of the point force exerted on the probe, measurement of the resistance exerted on the lateral wall of the probe, and measurement of the resistance exerted over the entire length of the set of tubes.

These three measurements take place simultaneously as the set of tubes is driven in. When the set of tubes is extracted only the value of the resistance exerted on the entire length of the set of tubes is measured.

In order to carry out these three measurements easily, the probe and assembly is currently made in three coaxial autonomous parts. The point force is recorded by means of a cap of conical shape, integral with a central rod formed by parts connected one after the other. The resistance exerted on the lateral wall of the probe is transmitted by means of an intermediate tube surrounding the central rod and formed, like the latter, of separate unit members placed end to end. The resistance exerted on the entire length of the set of tubes driven into the ground is applied to an outer tube which serves as a casing for the entire set of tubes and which is also formed by parts connected one after the other.

To measure these various resistances, one normally uses dynamometric rings or casings filled with a hydraulic fluid, in which case the measurement takes place by pressure sensors. These pressure-sensitive means generally lack accuracy and reliability and do not make it possible to record the measurements, considerably slowing down the tests.

A static recording penetrometer has already been described by BENGT B. BROMS and D. E. BROUSSARD in the "Journal of Soil Mechanic and Foundation Division, ASCE" of January 1965 (U.S.A.). The measurement is effected hydraulically and the recording systems generally comprise relatively delicate devices which withstand the hazards of open-air sites quite poorly and require frequent adjustment.

Certain designers have also used electronic extensometry pick-ups of the strain-gauge type, which prove to be very accurate, strong and compatible with various recording methods (see French Pat. Nos. 983,514 and 2,006,848). However, these devices have not been perfected: in particular they facilitate only a very limited number of separate measurements and their pick-ups are housed inside the probe, so that they are connected to the measuring apparatus and/or recording apparatus, located on the outside, by connecting wires which have to be extended as the probe penetrates further.

OBJECTS OF THE INVENTION

An object of the present invention is to remedy the drawbacks of known measuring devices, thus to provide a measuring device making it possible to carry out at least the three above-mentioned conventional measurements while using a measuring principle differing from dynamometric or hydraulic methods.

Another object is the provision of an improved apparatus facilitating automatic and therefore rapid recording, without the risk of transcription errors, the results being able to be interpreted immediately and compatible with modern means for the electronic processing of information so that the assembly forms a reliable and accurate system.

Yet another object of the invention is to provide a device which facilitates not only measurements of resistance to penetration, but also measurements of resistance to extraction, without its structure being made more complex. The object is thus to provide a measuring head facilitating, on the one hand, static driving-in of the set of tubes and, on the other hand, its extraction, while allowing the transmission of all forces to be be measured to the various pick-ups, extraction currently being carried out by special means such as jacks, rams, winches, jaws etc, which are bulky and complicate the structure of penetrometers.

SUMMARY OF THE INVENTION

To this end, the invention relates to a measuring device for a penetrometer, of the general type described above which is essentially constituted by a measuring head placed at the top of the set of tubes and composed of a cover acted upon by the anvil of the driving device, and of three parts fitted in the cover and in each other. These three parts define three chambers receiving three superimposed electronic pick-ups which measure the point force exerted on the probe, the resistance exerted on the probe arrangement, and the resistance exerted on the entire set of tubes. These various fitted parts ensure the transmission of forces between the various elements of the set of tubes and the electronic pick-ups which are connected to a system for processing and automatically recording the measurements.

In accordance with another feature of this invention the three parts fitted in the cover and in each other are a first cylindrical casing mounted inside the cover and bearing against the outer tube of the set of tubes, a second cylindrical casing mounted inside the first and bearing against the intermediate tube of the set of tubes, and a cap mounted at the top of the central rod of the set of tubes inside the second casing.

According to one feature of the invention, in its lower part the first casing comprising catches mounted to pivot about horizontal pivots and able to be actuated by rams in order to engage in a restricted part of the outer tube of the set of tubes for extraction. The measuring head is thus equipped with simple means constituting an extraction device.

Furthermore, in order that this measuring head facilitates measurement of the resistance to extraction, the first casing is formed by two parts, a lower part and upper part assembled with interposition of spacer members passing through a flange of said second casing, a shoulder cooperating with said flange being provided on the cover so that when the latter is pulled upward, the second casing is also drawn upward and entrains therewith the first casing and the entire set of tubes, thus compressing the intermediate pick-up which thus measures the resistance to extraction exerted on the entire length of the set of tubes.

According to another feature of the invention, the various electronic pick-ups are controlled by strain-gauge bridges providing a voltage proportional to the force exerted on the pick-up, which is supplied to the input of a voltmeter carrying out its measurement and transcribing it as coded information that is transmitted to a recorder.

Advantageously, a clock is provided for emitting at regular time intervals commands to measure and record the forces exerted on the various electronic pick-ups.

According to another feature for the interpretation of measurements, the recording means controlled by the clock is also connected to a device for the automatic counting of the number of hammer blows and to a device for measuring the penetration of the set of tubes.

The various measurement results are printed as the tests take place, by known means, with possible indication of the time of each measurement.

BRIEF DESCRIPTION OF THE DRAWING

The above and other objects, features, and advantages of the invention will become more readily apparent from the following description, reference being made to the accompanying drawing in which.

SPECIFIC DESCRIPTION

Figure 1:
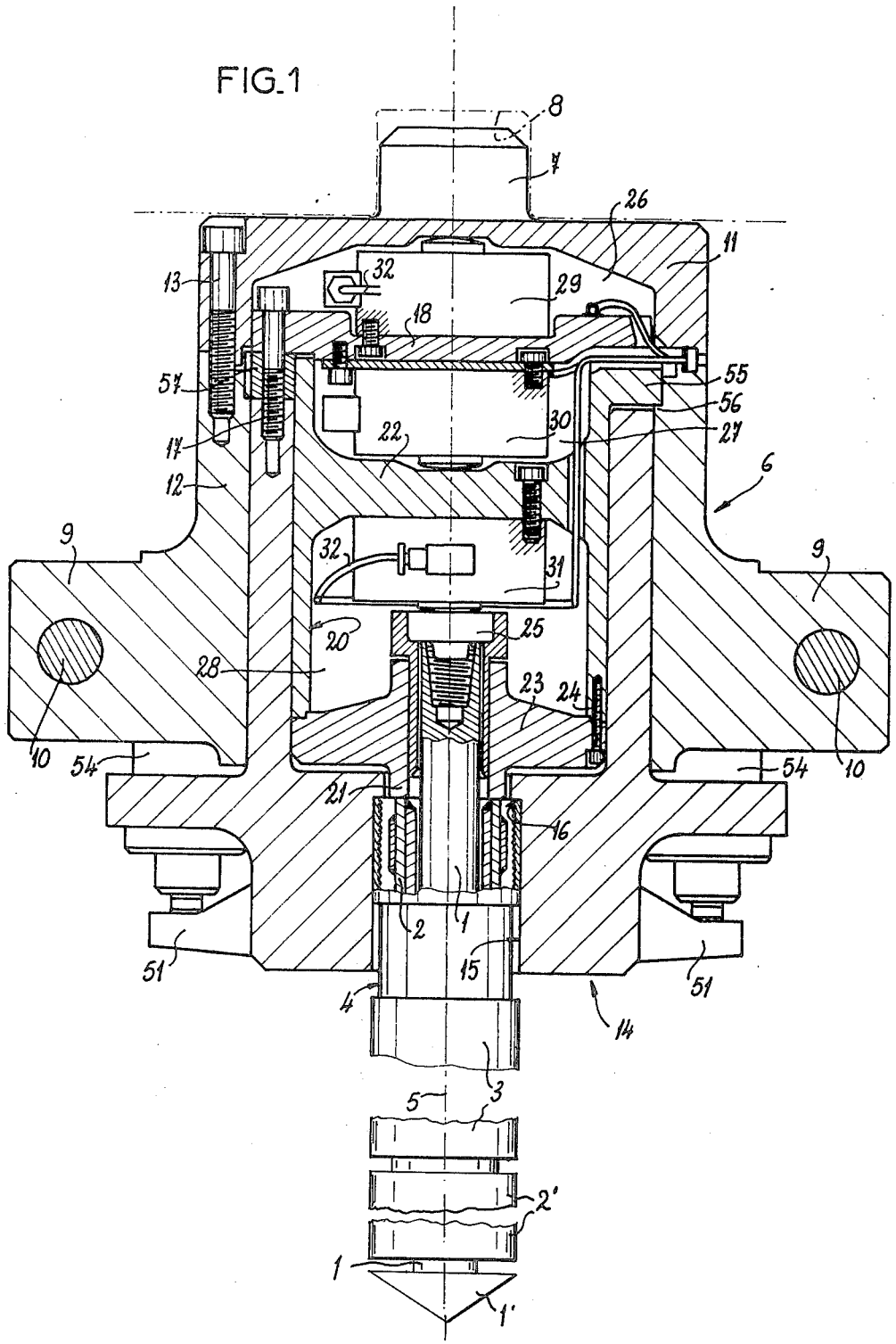
FIG. 1 is a sectional view passing through the axis of the set of tubes, showing the entire electronic measuring head.

The measuring head according to the invention is put in position at the top of a set of tubes which is, for example, that described in my above-cited U.S. application Ser. No. 543,951. This set of tubes is constituted by a central rod 1 which carries a point 1' and transmits the point force, an intermediate tube 2 surrounding the rod 1 which transmits the resistance exerted on the lateral wall of the probe at the exposed lower end 2' of this tube 2, and an outer tube 3 which transmits the resistance exerted on the entire length of the set of tubes.

It should also be noted that, at the top of this set of tubes, the central rod 1 extends above the upper edge of the tubes 2 and 3, whereas the outer tube 3 has a restricted part or outwardly open circumferential groove 4 whose function will be described below.

The measuring head is composed of several members fitted one in the other, all on the same axis 5 which is also the axis of the set of tubes. These parts are:

1. A cover 6 on top of the arrangement of the measuring head and comprising at its top a lug 7 ensuring its centering under the anvil 8 shown in dot-dash lines in FIG. 1. On its sides the cover 6 has two arms 9 traversed by rods 10 which make it possible to secure the measuring head to a sliding frame, descending along a fixed frame as the tubes are driven in, these members being described in my above-cited U.S. patent application Ser. No. 543,953 (U.S. Pat. No. 3,958,646). In the example shown the cover 6 is formed of an upper part 11 and a lower part 12, connected by bolts 13.

2. A first casing 14 of general cylindrical shape, slidably mounted inside the cover 6: and having at its base a cylindrical recess or bore 15 receiving the top of the set of tube elements 1–3. The recess 15 has a shoulder 16 against which bears the upper end of the outer tube 3. In the example illustrated, the casing 14 is also formed by the connection of an upper part 18 and lower part 19 by bolts 17.

3. A second cylindrical casing 20 slidably mounted inside the casing 14 and having at its lower part a cylindrical aperture through which passes the top of the central rod 1 and a rim 21 against which bears the upper end of the intermediate tube 2. The casing 20 is formed by the connection of an upper part 22 and lower part 23 by bolts 24.

4. A cap 25 disposed at the top of the central rod 1, inside the second casing 20 and slidably mounted with respect to the latter, guidance being ensured by the walls of the cylindrical aperture provided at the base of the casing 20.

The four parts which have been described define three superimposed chambers 26, 27 and 28. The upper chamber 26, defined by the parts 11 and 18 belonging respectively to the cover 6 and to the first casing 14, contains a first pick-up 29 for compression forces. The intermediate chamber 27, defined by the parts 18 and 22 belonging respectively to the first casing 14 and to the second casing 20, contains a second force pick-up 30 of the same type interposed between the member 22 of the casing 20 and the cap 25. Chamber 28 contains the third pick-up 31.

The three pick-ups 29, 30, 31 are fixed by means of screws visible in FIG. 1 and are connected to the outside by cables 32 which pass through passages provided in the cover 6 and the two casings 14 and 20 by which the respective chambers are open to the atmosphere. These pick-ups of compression forces are of the strain-gauge type for example, facilitating the measurement of forces up to 20 tons. Such devices are described on pages 343 and 344 of *Servomechanism Practice* by Ahrendt and Savant (McGraw-Hill:1960).

Considering the case of static penetration of the set of tubes, the function of the three pick-ups 29, 30, 31 is as follows:

1. The lower pick-up 31, subject to the resistance of the central rod 1, measures the point force on the probe.

2. The intermediate pick-up 30 is sensitive to forces transmitted by the central rod 1 through the intermediary of the pick-up 31 and the member 22 and to forces transmitted by the intermediate tube 2 and the second casing 20. It thus measures the total of the resistances exerted on the probe (lateral wall and point).

Figure 4:
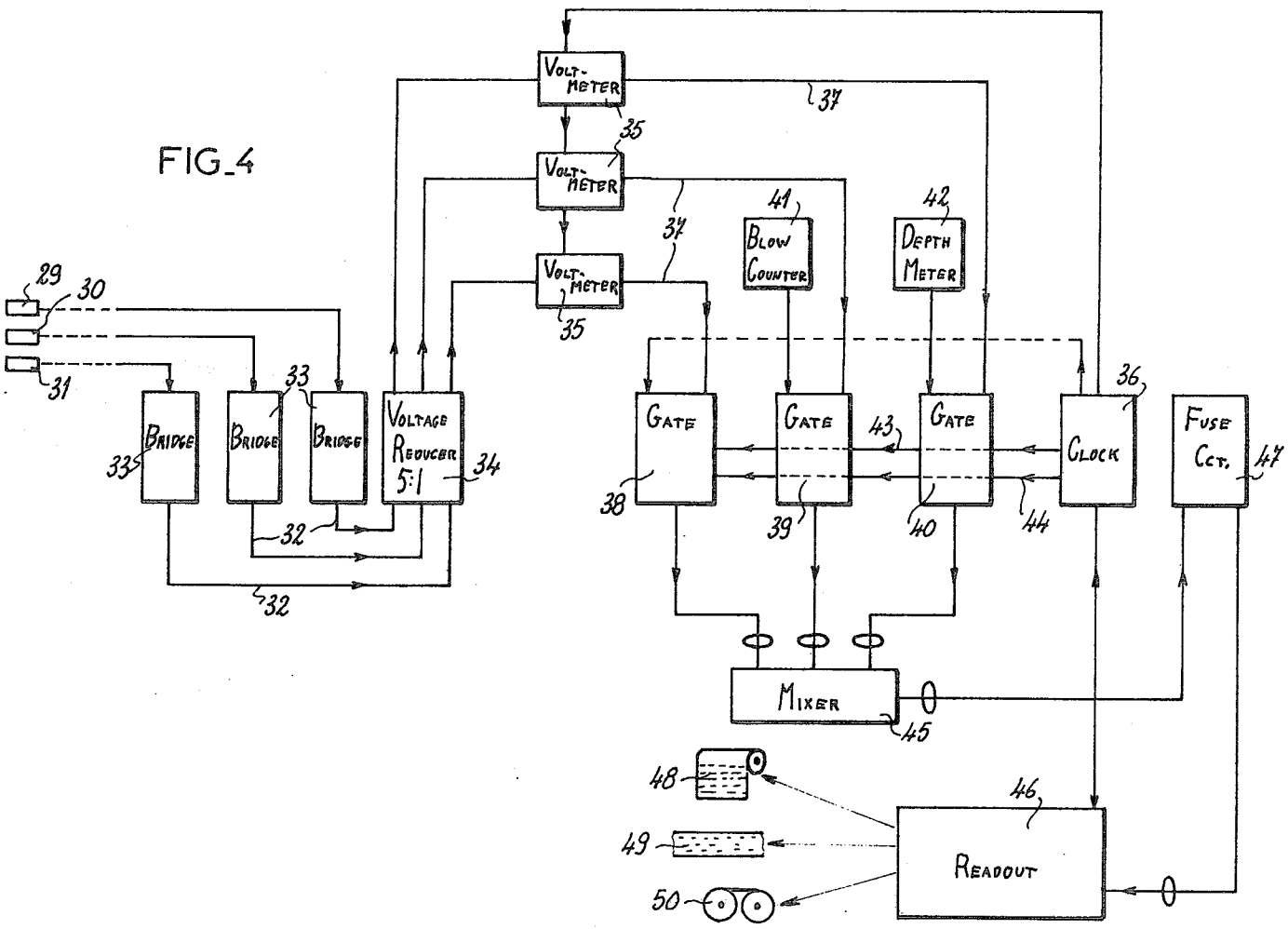
FIG. 4 is a circuit diagram of the system for processing and recording the measurements.

3. The upper pick-up 29 is first of all subject to forces transmitted through the pick-up 30 and part 18 and second to the forces transmitted directly by the first casing 14 bearing on the outer tube 1. This pick-up 29 thus measures the total resistance to penetration. Processing and recording the measurements carried out by means of the three pick-ups 29, 30 and 31 are undertaken by the system shown diagrammatically in FIG. 4.

The three pick-ups are controlled by strain-gauge bridges 33 which supply an electrical voltage proportional to the force exerted on the corresponding pick-up, for example a voltage of between 0 volts and 10 volts. These signals in the form of a variable voltage are fed by the cables 32 to a reducer 34 which divides this voltage by 5, in order to send it to the input of current digital voltmeters 35 which have a measuring range of between 0 and 2 volts. These voltmeters ensure recording of the measurement and its transcription into BCD code (binary coded decimal).

The measuring and printing process is controlled by a clock 36 which sends a signal to the voltmeters 35, every 5 seconds for example. The latter thus determine the voltage supplied by the bridges 33 and the reducer 34 and transmit the processed digital information on their output leads 37.

The leads 37 lead to three gates 38, 39 and 40. The first switch 38 receives firstly the measurement from the pick-up 31, secondly the signal from the clock 36. The second switch 39 receives firstly the measurement from the pick-up 30, secondly the information relating to the number of hammer blows, supplied by an automatic counting device 41.

The third switch 40 receives firstly the measurement from the pick-up 29, secondly the information relating to the penetration of the tubes into the ground, supplied by an automatic device 42 which is for example the device described in my above-cited patent application.

The clock 36 sends commands to the switches. A first clock signal, symbolized by the line 43, selects the measurements of forces at the switches 38, 39 and 40 which will be printed on a first line. A second clock signal, symbolized by the line 44, selects the other information (time, number of blows, depth) at the switches 38, 39 and 40, which information will be printed on a second line.

The selected information is supplied to a mixer 45 which sends it to the inputs of a readout or printing device 46. In the example illustrated, protection resistances of a fuse circuit 47 are also interposed between the mixer 45 and the printing machine 46. After printing the results on two lines, the clock 36 also sends a signal to the printing machine 46, in order to make it skip a line.

During static penetration, the measurement and printing of the three forces, of the time, and of the depth of penetration of the tubes are carried out at regular time intervals as determined by the clock 36. If necessary an automatic change of reduction is provided in the reducer 34, in order to increase the sensitivity at low levels of measurement.

The same system may also be used during dynamic penetration tests. However, only the information of the second line (time, number of blows, depth) is thus printed, the measuring head being withdrawn.

Hitherto, it was solely a question of a printing machine 46 which inscribes the results on a strip of paper 48, but for the subsequent processing of the measurements (use of a tracing table for establishing curves), it may be useful to also record the measurements on a perforated tape 49 or magnetic tape 50.

The device aforedescribed and in particular its measuring head are also provided to facilitate measurement of the resistance exerted on the entire length of the set of tubes, for an extraction test.

Figure 2:
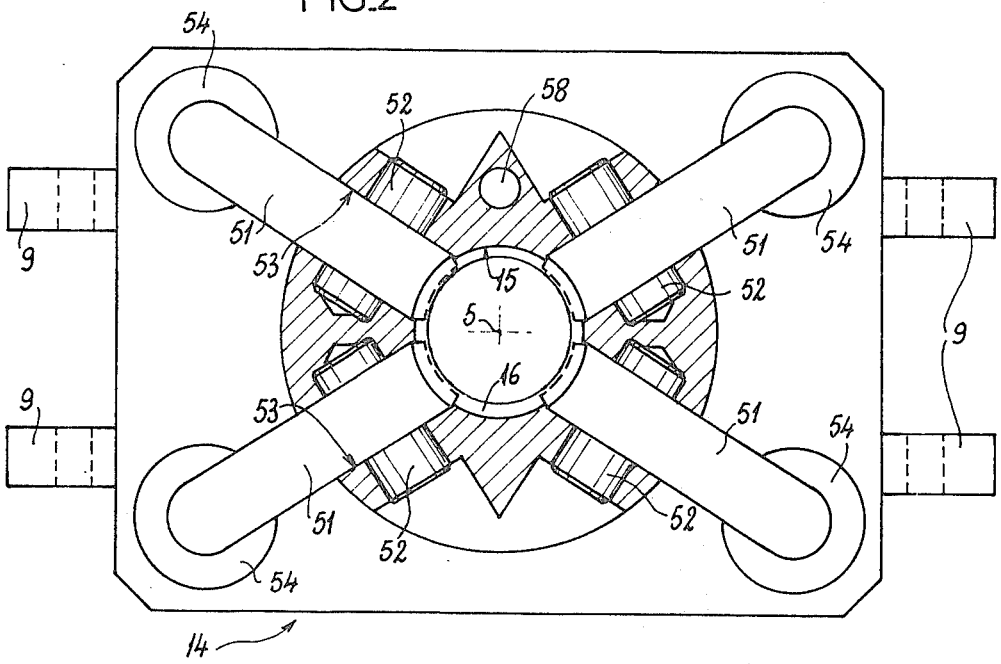
FIG. 2 is a bottom view partly in section showing this head and in particular the extraction catches.
Figure 3:
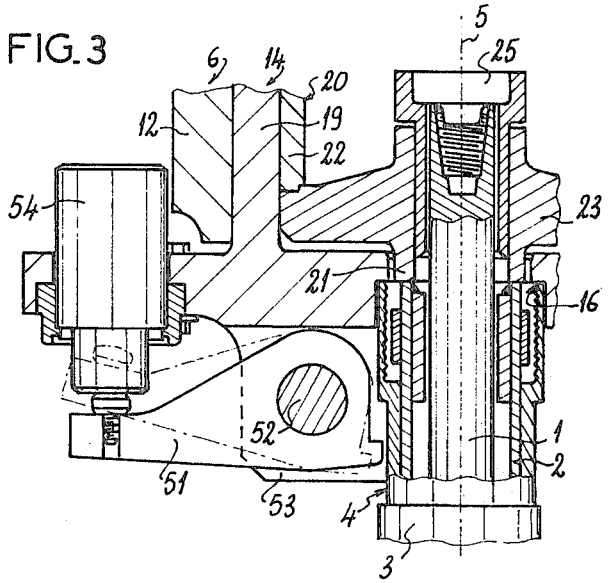
FIG. 3 is a partial view of this head, in section, illustrating the operation of the extraction catches.

As shown in particular in FIGS. 2 and 3, four extraction catches or pawls 51 are mounted to pivot about respective horizontal pivots 52 in the lower member 19 of the first casing 14. These catches 51 are disposed in notches 53 opening into the recess 15 receiving the top of the set of tubes. Four rams 54 having a vertical axis make it possible to pivot the catches 51 by exerting a thrust on their outer ends.

The position of the catches 51 shown in dot-dash lines in FIG. 3 is the position normally used during static penetration tests. The position shown in solid lines is that used during extraction tests. The front ends of the catches 51 thus engage in the groove 4 of the outer tube 3.

For extraction the catches 51 are placed in the solid-line position and the penetrometer is operated to raise the movable frame on which the measuring head has been fixed by means of the rods 10.

The cover 6 is thus drawn upward and entrains the second casing 20 which comprises at its top as shown in FIG. 1, a flange 55 abutting an abutment shoulder 56 of the cover. This flange is traversed by the screws 17 of the first casing 14 and by spacer members 57 interposed between the two parts 18 and 19 of this casing.

The first casing 14 which supports the extraction catches 51 is on the contrary drawn downwards, such that the intermediate pick-up 30 is compressed between the parts 18 and 22 belonging respectively to the two casings 14 and 20. In this manner, the pick-up 30 measures the total force upon extraction, which may be printed and recorded by the means described above with reference to FIG. 4.

It should also be noted that the rams 54 are supplied with a pressure depending on the extraction pressure, in order to prevent any undesirable separation of the catches 51 and that these rams and catches also make it possible to lock the measuring head in a storage position, on a lug comprising a groove similar to the restricted part 4 of the outer tube 3. Furthermore, the lower part 19 of the casing 14 is formed with a bore 54 cooperating with a finger member for preventing the measuring head from rotating, in the storage position.

I claim:

1. In a penetrometer wherein an anvil drives in an axis-defining probe having a center element carrying a drive point, an intermediate tubular element surrounding said center element and having a lower end exposed adjacent said point, and an outer tubular element surrounding said intermediate element above the lower end thereof, the improvement comprising:

a cap member engageable by said anvil;

an upper member axially displaceable relative to said cap member and having a lower side in force-transmitting engagement with said outer element;

an intermediate member axially displaceable relative to said upper member and having a lower side in force-transmitting engagement with said intermediate element;

a lower member axially displaceable relative to said intermediate member and having a lower side in force-transmitting engagement with said center element;

respective upper, intermediate, and lower strain gauges between said upper, intermediate, and lower members and said cap, upper, and intermediate members for producing respective outputs corresponding to the pressures exerted by the respective members on each other; and recording means connected to said strain gauges for registering said outputs, said upper, intermediate, and lower members being each at least partially received in and slidable piston-fashion in said cap, upper, and intermediate members, respectively, said upper, intermediate, and lower members having respective upper sides spaced below the respective lower sides of said cap, upper, and intermediate members, each strain gauge being engaged between the respective upper side and the adjacent lower side.

2. The improvement defined in claim 1 wherein said cap member is provided with an abutment limiting axial displacement of said upper member away from said cap member, said upper member being provided with means for locking itself onto said outer tube.

3. The improvement defined in claim 2 wherein said outer tube is formed with an outwardly open groove, said means for locking including a plurality of pawls engageable in said groove and pivoted on said upper member, and means for pivoting said pawls between a position engaging in said groove and a position out of engagement with said groove.

4. The improvement defined in claim 2 wherein said cap member is formed with an inwardly open groove constituting said abutment, said intermediate member being provided with an outwardly extending flange received in said inwardly open groove and limitedly axially displaceable therein, whereby lifting of said cap member with said upper member locked on said outer tube compresses said intermediate strain gauge.

5. In a penetrometer wherein an anvil drives in an axis-defining probe having a center element carrying a drive point, an intermediate tubular element surrounding said center element and having a lower end exposed adjacent said point, and an outer tubular element surrounding said intermediate element above the lower end thereof, the improvement comprising:

a cap member engageable by said anvil;

an upper member axially displaceable relative to said cap member and having a lower side in force-transmitting engagement with said outer element;

an intermediate member axially displaceable relative to said upper member and having a lower side in force-transmitting engagement with said intermediate element;

a lower member axially displaceable relative to said intermediate member and having a lower side in force-transmitting engagement with said center element;

respective upper, intermediate, and lower strain gauges between said upper, intermediate, and lower members and said cap, upper, and intermediate members for producing respective outputs corresponding to the pressures exerted by the respective members on each other; and recording means connected to said strain gauges for registering said outputs, said upper, intermediate, and lower members being each at least partially received in and slidable piston-fashion in said cap, upper, and intermediate members, respectively, said cap member being provided with an abutment limiting axial displacement of said upper member away from said cap member, said upper member being provided with means for locking itself onto said outer tube. said cap member being formed with an inwardly open groove constituting said abutment, said intermediate member being provided with an outwardly extending flange received in said inwardly open groove and limitedly axially displaceable therein, whereby lifting of said cap member with said upper member locked on said outer tube compresses said intermediate strain gauge, said upper, intermediate, and lower members having respective upper sides spaced below the respective lower sides of said cap, upper, and intermediate members, each strain gauge being engaged between the respective upper side and the adjacent lower side.

6. The improvement defined in claim 5 wherein said upper, intermediate and lower members form respective chambers with said top, upper, and intermediate members, said chambers being open to the atmosphere.

7. The improvement defined in claim 5 wherein said recording means includes a respective electrical bridge for an including each of said strain gauges and voltage-measuring means connected to each of said bridges.

8. The improvement defined in claim 7 wherein said recording means includes a clock for periodically registering the voltage measured by each of the voltage-measuring means.

9. The improvement defined in claim 8 wherein said recording means includes means for permanently registering said voltages measured.

10. In a penetrometer wherein an anvil drives in an axis-defining probe having a center element carrying a drive point, an intermediate tubular element surrounding said center element and having a lower end exposed adjacent said point, and an outer tubular element surrounding said intermediate element above the lower end thereof, the improvement comprising:

a cap member engageable by said anvil;

an upper member axially displaceable relative to said cap member and having a lower side in force-transmitting engagement with said intermediate element;

a lower member axially displaceable relative to said intermediate member and having a lower side in force-transmitting engagement with said center element;

respective upper, intermediate, and lower strain gauges between said upper, intermediate, and lower members and said cap, upper, and intermediate members for producing respective outputs corresponding to the pressures exerted by the respective members on each other; and recording means connected to said strain gauges for registering said outputs, said upper, intermediate, and lower members having respective upper sides spaced below the respective lower sides of said cap, upper, and intermediate members, each strain gauge being engaged between the respective upper side and the adjacent lower side.

* * * * *